US009048550B2

(12) United States Patent
Onuma et al.

(10) Patent No.: US 9,048,550 B2
(45) Date of Patent: Jun. 2, 2015

(54) CRIMPED TERMINAL

(75) Inventors: Masanori Onuma, Shizuoka (JP); Kousuke Takemura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 14 days.

(21) Appl. No.: 13/814,118

(22) PCT Filed: Jul. 15, 2011

(86) PCT No.: PCT/JP2011/066210

§ 371 (c)(1),
(2), (4) Date: Feb. 4, 2013

(87) PCT Pub. No.: WO2012/017806

PCT Pub. Date: Feb. 9, 2012

(65) Prior Publication Data

US 2013/0130567 A1 May 23, 2013

(30) Foreign Application Priority Data

Aug. 5, 2010 (JP) ..... 2010-176046

(51) Int. Cl.

| | |
|---|---|
| ***H01R 4/10*** | (2006.01) |
| ***H01R 4/28*** | (2006.01) |
| ***H01R 4/18*** | (2006.01) |

(52) U.S. Cl.

CPC ..... *H01R 4/28* (2013.01); *H01R 4/188* (2013.01); *H01R 4/185* (2013.01)

(58) Field of Classification Search

USPC ..... 439/877, 880–882, 442, 851, 878, 885

See application file for complete search history.

(56) References Cited

U.S. PATENT DOCUMENTS 8,177,591 B2 * 5/2012 Okamura et al. ..... 439/877

FOREIGN PATENT DOCUMENTS

| | | | |
|---|---|---|---|
| JP | 55-96575 | A | 7/1980 |
| JP | 2009-245695 | A | 10/2009 |
| JP | 2009-252449 | A | 10/2009 |
| JP | 2010-198776 | A | 9/2010 |

OTHER PUBLICATIONS

Japanese Office Action for corresponding Application No. 2010-176046 issued Jul. 22, 2014.

Communication dated Mar. 3, 2015 from the Japanese Patent Office in counterpart application No. 2010-176046.

* cited by examiner

*Primary Examiner* — Jean F Duverne

(74) *Attorney, Agent, or Firm* — Sughrue Mion, PLLC

(57) ABSTRACT

In a crimp terminal (1) with a conductor crimp portion (11) having recessed serrations in the inner surface (11R), circular recesses (20) as serrations are provided in an inner surface (11R) of the conductor crimp portion (11) to be scattered so as to be spaced from each other before the conductor crimp portion (11) is crimped to a conductor (Wa) of an electric wire (W). A strip-shaped serration non-forming region (22) is provided in an intermediate portion in a front-back direction of the conductor crimp portion (11) and formed without the recesses (20).

4 Claims, 6 Drawing Sheets

(a)

(b)

CRIMPED TERMINAL

TECHNICAL FIELD

The present invention relates to an open barrel type of crimp terminal used, for example, in an electric system of an automobile and having a conductor crimp portion having a U-shaped cross section.

BACKGROUND ART

FIG. 1 is a perspective view illustrating a constitution of a related art crimp terminal described in Patent Document 1, for example.

A crimp terminal 101 is provided with an electric connection portion 110, which is provided in a front portion in a longitudinal direction of the terminal (a longitudinal direction of a conductor of an electric wire to be connected to the terminal) and connected to a terminal on a mating connector side, a conductor crimp portion 111, which is provided behind the electric connection portion 110 and crimped to an exposed conductor of an end of an electric wire (not illustrated), and a coated crimping portion 112 provided further behind the conductor crimp portion 111 and crimped to a portion with an insulating coating of the electric wire. The crimp terminal 101 is further provided with a first connection portion 113, which is provided between the electric connection portion 110 and the conductor crimp portion 111 and connects the electric connection portion 110 and the conductor crimp portion 111, and a second connection portion 114 provided between the conductor crimp portion 111 and the coated crimping portion 112 and connects the conductor crimp portion 111 and the coated crimping portion 112.

The conductor crimp portion 111 is formed to have a substantially U-shaped cross section by a bottom plate 111A, a pair of coated crimping pieces 111B, 111B provided to extend upwardly from both the right and left side edges of the bottom plate 111A and crimped so as to wrap a conductor of an electric wire disposed on an inner surface of the bottom plate 111A. The coated crimping portion 112 is formed to have a substantially U-shaped cross section by a bottom plate 112A and a pair of coated crimping pieces 112B, 112B provided to extend upwardly from both the right and left side edges of the bottom plate 112A and crimped so as to wrap an electric wire (portion with an insulating coating) disposed on an inner surface of the bottom plate 112A.

The first connection portion 113 and the second connection portion 114 provided respectively in front of and behind the conductor crimp portion 111 are formed to have a U-shaped cross section respectively by bottom plates 113A and 114A and low profile side plates 113B and 114B uprising from both the right and left side edges of the bottom plates 113A and 114A.

The bottom plates (the bottom plate 113A of the first connection portion 113, the bottom plate 111A of the conductor crimp portion 111, the bottom plate 114A of the second connection portion 114, and the bottom plate 112A of the coated crimping portion 112) ranging from the bottom plate (not illustrated) of the electric correction portion 110 on the front side to the coated crimping portion 112 on the tail end side are continuously formed into a band plate shape. The front and rear ends of a low profile side plate 113B of the first connection portion 113 are continued respectively to a lower half portion of a rear end of a side plate (reference numeral is omitted) of the electric connection portion 110 and a lower half portion of a front end of the conductor crimping piece 111B of the conductor crimp portion 111, and the front and rear ends of a low profile side plate 114B of the second connection portion 114 are continued respectively to a lower half portion of a rear end of the conductor crimping piece 111B of the conductor crimp portion 111 and a lower half portion of a front end of the coated crimping piece 112B of the coated crimping portion 112.

Among an inner surface 111R and an outer surface 111S of the conductor crimp portion 111, the inner surface 111R on the side in contact with the conductor of the electric wire is provided with a plurality of recessed groove-shaped serrations 120 extending in a direction perpendicular to a direction (terminal longitudinal direction) in which the conductor of the electric wire extends.

FIG. 2 is a detail view of the serrations 120 formed in an inner surface of the conductor crimp portion 111. FIG. 2(*a*) is a developed plan view of the conductor crimp portion 111, FIG. 2(*b*) is a IIb-IIb arrowed cross-sectional view of FIG. 2(*a*), and FIG. 2(*c*) is an enlarged view of a IIc portion of FIG. 2(*b*).

The cross-sectional shape of the recessed groove-shaped serrations 120 is a rectangular shape or an inverted trapezoidal shape, and an inner bottom surface 120A is formed substantially parallel to an outer surface 1115 of the conductor crimp portion 111. An inner corner portion 120C at which an inner side surface 120B and the inner bottom surface 120A intersect each other is formed as an angular portion at which a plane and a plane intersect each other. A hole edge 120D at which the inner side surface 120B and the inner surface 111R of the conductor crimp portion 111 intersect each other is formed as an edge.

As illustrated in FIG. 3, the conductor crimp portion 111 having the above serrations 120 is generally manufactured by pressing using a die 200 (actually, this is so-called a serration die which is assembled on an upper die of a press die) having protrusions 220 provided at positions corresponding to the recessed groove-shaped serrations 120.

In the die 200 in the above case, as illustrated in FIG. 4, since the protrusions 220 are linear, the die 200 is manufactured by grinding an upper surface of a block 210 with the use of a grindstone. FIG. 5 illustrates an external appearance of the die 200.

When the conductor crimp portion 111 of the crimp terminal 101 constituted as above is crimped to the conductor of the end of the electric wire, the crimp terminal 101 is placed on a placing surface (upper surface) of a lower die (anvil) (not illustrated), and, at the same time, the conductor of the electric wire is inserted between the conductor crimping pieces 111A of the conductor crimp portion 111 and placed on an upper surface of the bottomplate 111A. Then, an upper die (crimper) is relatively lowered relative to the lower die, whereby a front end side of the conductor crimping piece 111B is gradually pulled inward by a guide slope of the upper die.

The upper die (crimper) is then further relatively lowered relative to the lower die, whereby eventually the front end of the conductor crimping piece 111B is rounded so as to be folded back to the conductor side by a curved surface continued from the guide slope of the upper die to a central mountain-shaped portion, and the front ends of the conductor crimping pieces 111B are dug in the conductor while rubbing each other, whereby the conductor crimping pieces 111B are crimped so as to wrap the conductor.

According to the above operation, the conductor crimp portion 111 of the crimp terminal 101 can be connected to the conductor of the electric wire by crimping. Similarly, in the coated crimping portion 112, the coated crimping piece 112B are gradually folded inward by using lower and upper dies and crimped to a portion with an insulating coating of the electric wire. Consequently, the crimp terminal 101 can be electrically and mechanically connected to the electric wire.

When the crimping is performed, the conductor of the electric wire enters into the serrations 120 in the inner surface of the conductor crimp portion 111 by a pressure force while being plastically deformed, whereby connection between the crimp terminal 101 and the electric wire is reinforced.

CITATION LIST

Patent Literature

Patent Literature 1: JP 2009-245695 A (FIG. 1)

SUMMARY OF INVENTION

In the above related art crimp terminal 101, although the recessed groove-shaped serrations 120 perpendicular to the direction in which the electric wire extends are provided in the inner surface 111R of the conductor crimp portion 111, a sufficient contact conductivity cannot be always obtained.

Namely, when the conductor crimp portion 111 is crimped to the conductor of the electric wire, a surface of the conductor flowed by a pressing force and the hole edges 120D of the serrations 120 rub each other, or the surface of the conductor entering into the serrations 120 and the inner side surfaces of the serrations 120 rub each other, so that an oxide film on the surface of the conductor is peeled off, and an exposed newly formed surface is in contact with and electrically connected to the terminal. In this light, since the related art serrations 120 are linear ones, when the conductor of the electric wire flows in the longitudinal direction of the terminal, although the serrations 120 exhibit the effectiveness, the serrations 120 can hardly exhibit the effectiveness for extension of the conductor in other directions. Thus, a satisfactorily high contact conductivity cannot be always obtained.

When a die manufactured by grinding processing is used, roundness of the front end peripheral edge of the protrusion 220 of the pressing die 200 is easily reduced, whereby, as illustrated in FIGS. 2(*b*) and 2(*c*), the inner corner portion 120C of the crimp terminal 101 being a workpiece at which the inner bottom surface 120A and the inner side surface 120B intersect each other is angulated, and in a state in which the conductor crimp portion 111 is crimped to the conductor of the electric wire, the conductor entering inside the serrations 120 is not satisfactorily applied across the inner corner portion 120C, so that a gap is easily generated in the inner corner portion 120C. Thus, when a large gap is generated between the inner corner portion 120C and the conductor of the electric wire, this gap becomes a starting point of growth of the oxide film due to such as thermal shock and mechanical vibration, and the contact conductivity between the conductor and the terminal 101 may be reduced.

When a die manufactured by grinding processing is used, an outer circumference edge of a grindstone cannot be sharpened in order to prevent the outer circumference edge from being chipped, or the corner is gradually removed by friction as the grindstone is used, whereby roundness of a base of the protrusion 220 of the pressing die 200 is increased, so that roundness of the hole edge 120D of the serration 120 of the crimp terminal 101 being a workpiece is easily increased. When the roundness of the hole edge 120D is increased, some problems easily occur in a state after crimping.

Namely, the hole edge 120D of the serration 120 presses the conductor which is to deform in the front-back direction and prevents the conductor from moving in the front-back direction, whereby there is provided an effect of facilitating rubbing between a conductor flowing in the serration 120 or a conductor extending in the longitudinal direction outside the serration 120 and the terminal and improving the peelability of the oxide film. However, roundness of the hole edge 120D is increased, the effect is blunted, and the conductor easily moves when receives thermal shock and mechanical vibration, so that a contact resistance between the terminal and the conductor increases.

Thus, the present applicant has developed a crimp terminal provided in an inner surface of a conductor crimp portion so that a large number of small circular recesses as serrations are scattered in a state of being spaced apart from each other. According to this crimp terminal, it is considered that the following effects can be obtained.

Namely, when a conductor crimp portion is crimped to a conductor of an electric wire by using the above crimp terminal, the conductor of the electric wire enters into the small circular recesses provided as the serrations in the inner surface of the conductor crimp portion while being plastically deformed, so that connection between the terminal and the conductor can be reinforced. In such case, the surface of the conductor flowed by a pressing force and a hole edge of each of the recesses rub each other, or the surface of the conductor entering into the recesses and inner side surfaces of the recesses rub each other, so that an oxide film on the surface of the conductor is peeled off, and an exposed newly formed surface is in contact with and electrically connected to the terminal. Moreover, in this crimp terminal, since a larger number of the small circular recesses are provided so as to be scattered, the total length of the hole edge of the recess exhibits the effectiveness when the oxide film is scraped away regardless of an extending direction of the conductor. Accordingly, compared with the above related art crimp terminal provided with the linear serrations crossing in the extending direction of the conductor of the electric wire, the contact conduction effect according to exposure of a newly formed surface can be enhanced.

When linear serrations are pressed, linear protrusions should be formed in a pressing die, and therefore, processing of the protrusions has to depend on grinding processing. However, when a large number of small circular protrusions for serration processing are formed in the pressing die, it is possible to easily depend on a processing method other than the grinding processing. For example, when the linear protrusions are formed in the pressing die, if the protrusions are to be formed by electrical discharge machining, although the linear recesses are required to be formed in a discharge electrode, it is actually very difficult to form the linear recesses in the metal block, and therefore, it is unreasonable to perform the electrical discharge machining. However, when a large number of small circular recesses for serration processing are formed in a pressing die, the protrusions of the die can be easily formed by the electrical discharge machining or the like. For example, when the electrical discharge machining is used, a large number of the small circular protrusions can be transferred to the die simply by drilling a large number of small circular recesses as circular holes in a base material block of an electrode. Accordingly, processing can be facilitated.

When the conductor crimp portion is crimped to a conductor of an end of an electric wire by using an upper die (crimper) and a lower die (anvil), the conductor extends in the front-back direction in the conductor crimp portion. When the conductor extends, the flowing conductor rubs with hole edges of serrations, whereby an oxide film on the surface of the conductor is peeled off, and a newly formed surface of the conductor is in contact with and electrically connected to the terminal. In such case, in the conductor, a portion of the conductor located in front of an intermediate point in the front-back direction extends forward, and a portion behind the intermediate point in the front-back direction extends backward. Namely, in the conductor crimp portion, it is considered that an intermediate portion in the front-back direction of the conductor moves little in the front-back direction. Accordingly, as in the above case, when a large number of the small circular recesses as the serrations are scattered in the inner surface of the conductor crimp portion, the recesses arranged in the intermediate portion hardly function and are wasted.

In the crimping, although a thinned portion of a bottom portion of the serration (small circular recess) is concentrically extended, if the number of the serrations is large, a volume of a terminal material deformed with pressing at the time of crimping is increased, and since an escaping amount of the terminal material is increased, finishing accuracy of a crimped portion may be lowered.

When the conductor crimp portion is crimped, a crimp height (height of a portion in which the conductor crimp portion is crimped to the conductor) as a standard of compressibility is required to be measured by a stable portion with as few serrations as possible. However, when small circular recesses are widely scattered, it is difficult to determine where the crimp height is measured, and compressibility management at the site is troublesome.

An object of the present invention is to provide a crimp terminal which reduces useless serrations and can enhance crimping accuracy and facilitate compressibility management.

An aspect of the present invention is a crimp terminal including: an electrical connection portion provided in a front portion in a longitudinal direction of the crimp terminal; and a conductor crimp portion provided behind the electrical connection portion and crimped and connected to a conductor of an end of an electric wire, the conductor crimp portion having a cross section formed into a U-shape by a bottom plate and a pair of conductor crimp pieces provided to extend upwardly from both right and left side edges of the bottom plate and crimped to wrap the conductor disposed on an inner surface of the bottom plate, wherein the conductor crimp portion before being crimped to the conductor of the end of the electric wire includes, in an inner surface of the conductor crimp portion, circular recesses as serrations scattered to be spaced from each other, and a strip-shaped serration non-forming region provided in an intermediate portion in a front-back direction of the conductor crimp portion and formed without the recesses.

According to the above aspect, since the strip-shaped non-forming region where small circular recesses as the serrations are not formed is secured in the intermediate portion in the front-back direction of the conductor crimp portion, useless serrations of limited use are eliminated, and processability can be improved. Since the volume to be pressed at the time of crimping can be reduced by reducing the number of the serrations, an escaping amount of a terminal material at the time of crimping can be reduced, so that dimensional accuracy of a crimped portion can be improved. Since the compressibility at a portion formed with no serration can be measured, variation of a sample for compressibility observation is reduced, and compressibility measurement accuracy is improved; therefore, compressibility management at the site is facilitated.

DESCRIPTION OF EMBODIMENTS

Hereinafter, an embodiment of the present invention will be described with reference to the drawings.

Figure 1:
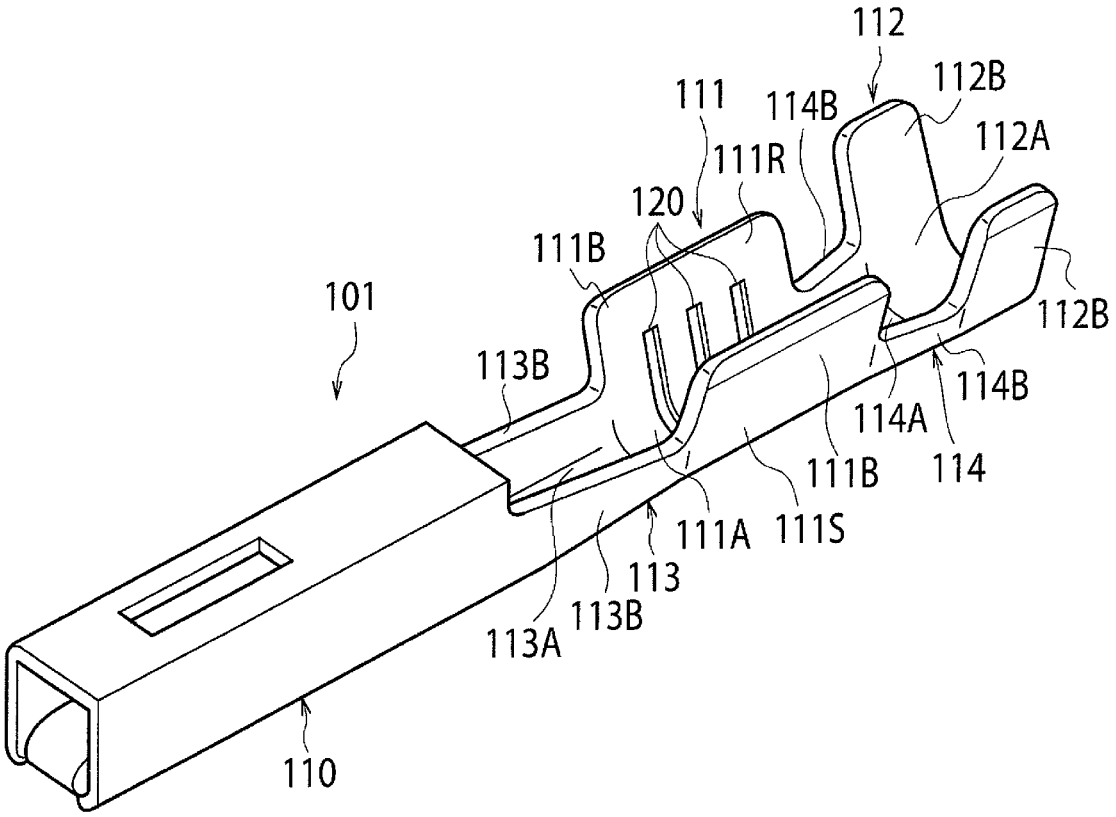
FIG. 1 is a perspective view illustrating a constitution of a related art crimp terminal.
Figure 2:
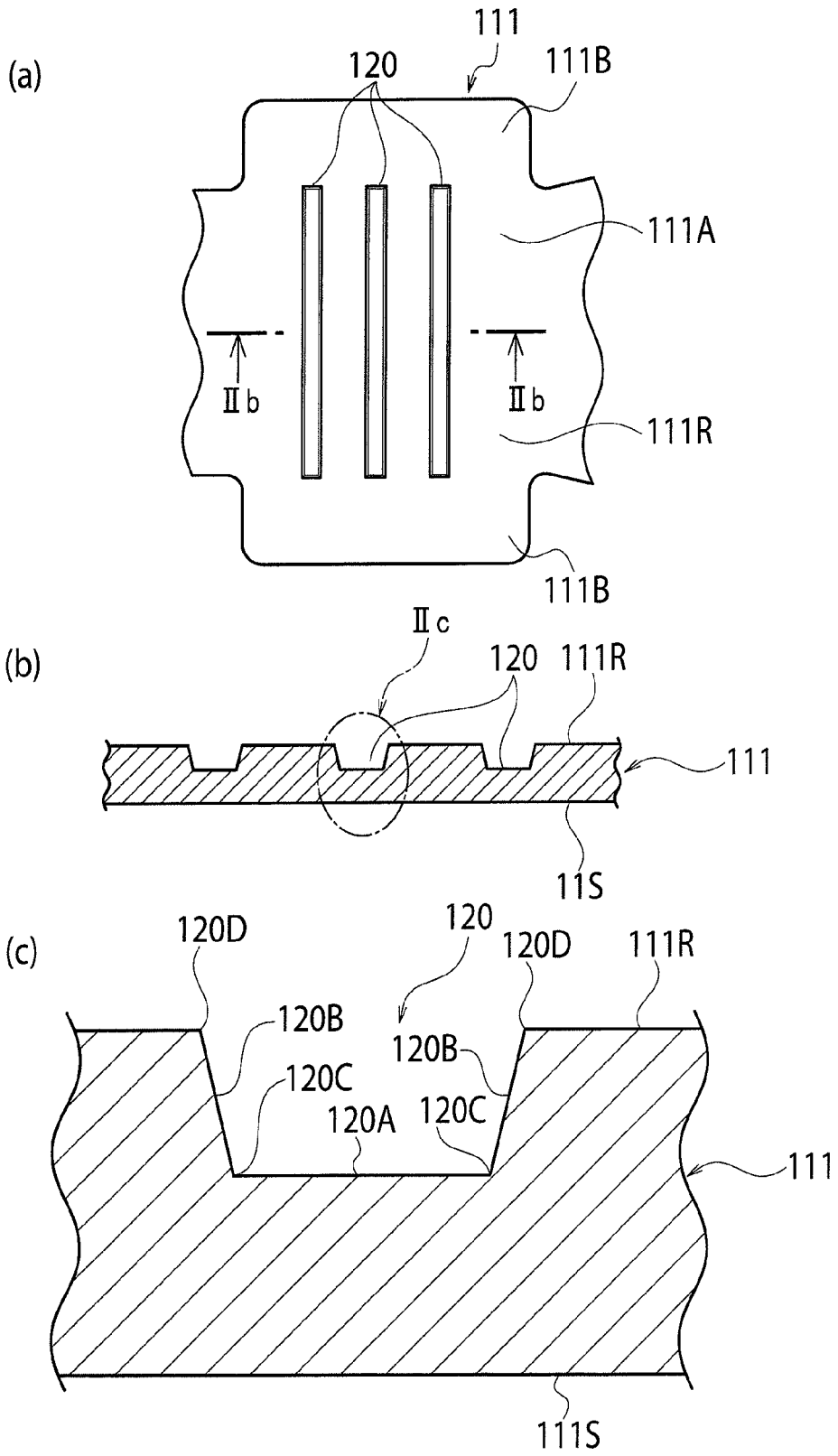
FIG. 2 is a view illustrating a state of a conductor crimp portion of the crimp terminal of FIG. 1 before crimping, FIG. 2(*a*) is a development plan view, FIG. 2(*b*) is a IIb-IIb arrowed cross-sectional view of FIG. 2(*a*), and FIG. 2(*c*) is an enlarged view of a IIc portion of FIG. 2(*b*).
Figure 3:
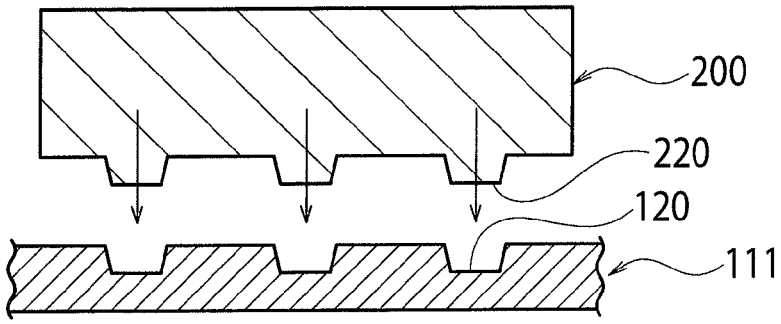
FIG. 3 is a cross-sectional view illustrating a state in which serrations of the crimp terminal of FIG. 1 are pressed.
Figure 4:
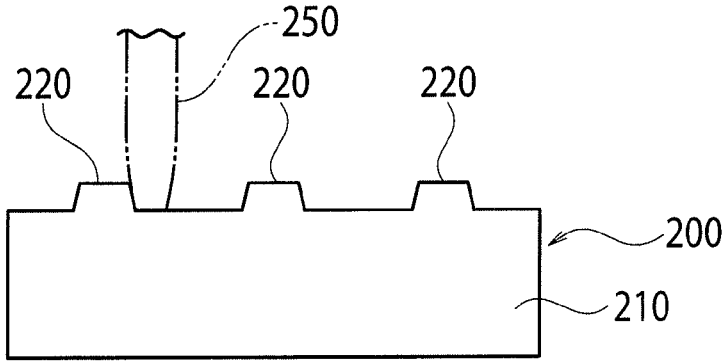
FIG. 4 is a side view illustrating a state in which protrusions for serration processing are formed in a pressing die of FIG. 3, used in pressing, by grinding processing.
Figure 5:
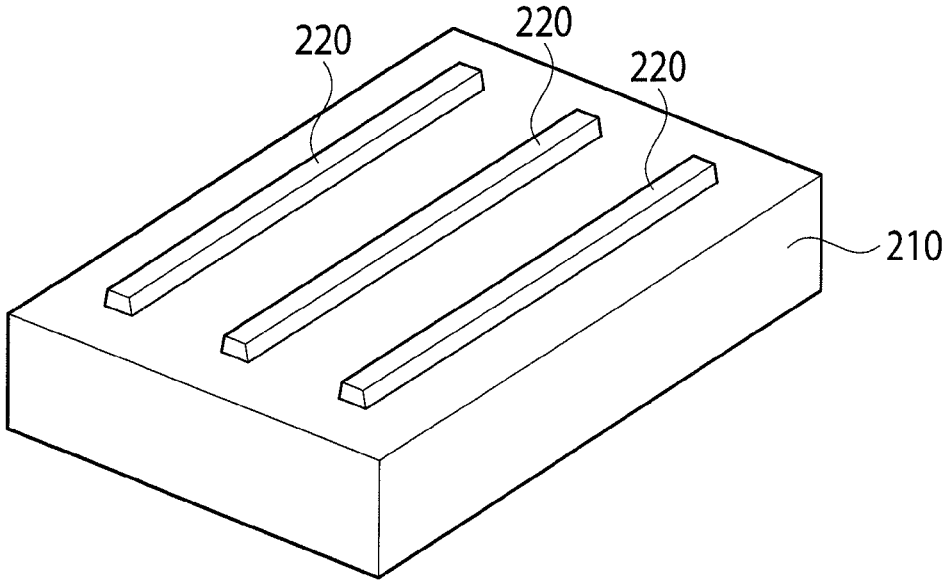
FIG. 5 is an external appearance perspective view of a pressing die manufactured through the processing in FIG. 4.
Figure 6:
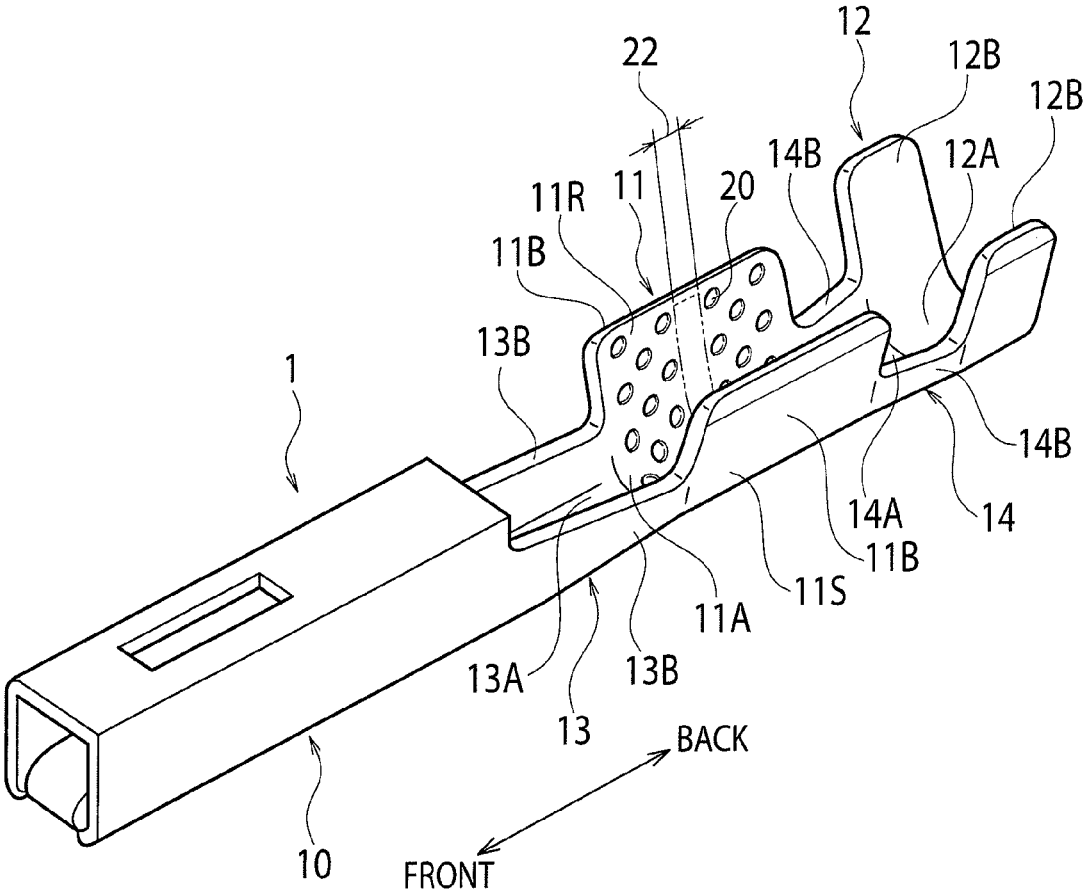
FIG. 6 is a perspective view illustrating a constitution of a crimp terminal according to an embodiment of the present invention.
Figure 7:
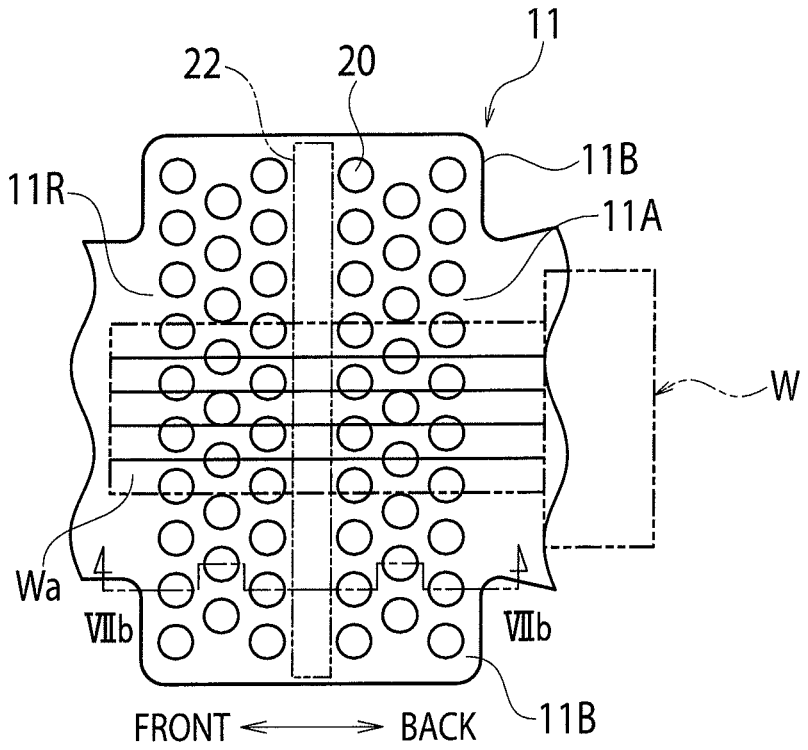
FIG. 7 is a view illustrating a state of a conductor crimp portion of the crimp terminal of FIG. 6 before crimping, FIG. 7(*a*) is a development plan view, and FIG. 7(*b*) is a VIIb-VIIb arrowed cross-sectional view of FIG. 7(*a*).
Figure 7:
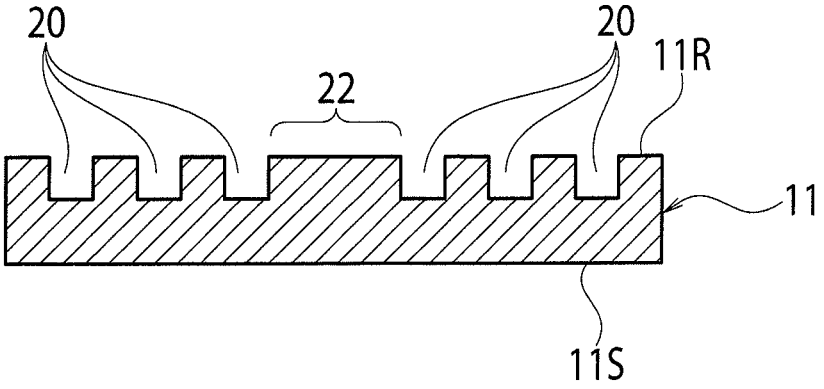

FIG. 6 is a perspective view illustrating a constitution of a crimp terminal 1 of the embodiment. FIG. 7 is a view illustrating a state of a conductor crimp portion 11 of the crimp terminal 1 before crimping, FIG. 7(*a*) is a development plan view, and FIG. 7(*b*) is a VIIb-VIIb arrowed cross-sectional view of FIG. 7(*a*).

As illustrated in FIG. 6, the crimp terminal 1 is of female type and is provided with a box-type electrical connection portion 10, which is provided in a front portion in the longitudinal direction of the terminal (a longitudinal direction of a conductor of an electric wire to be connected to the terminal, that is, a direction in which the electric wire extends) and connected to a male terminal on a mating connector side, a conductor crimp portion 11 provided behind the electrical connection portion 10 and crimped to an exposed conductor Wa (see, FIG. 7) of an end of an electric wire W, and a coated crimping portion 12 provided further behind the conductor crimp portion 11 and crimped to a portion with an insulating coating of the electric wire. The crimp terminal 1 is further provided with a first connection portion 13, which is provided between the electrical connection portion 10 and the conductor crimp portion 11 and connects the electrical connection portion 10 and the conductor crimp portion 11, and a second connection portion 14 provided between the conductor crimp portion 11 and the coated crimping portion 12 and connects the conductor crimp portion 11 and the coated crimping portion 12.

The conductor crimp portion 11 is formed to have a substantially U-shaped cross section by a bottom plate 11A and a pair of conductor crimping pieces 11B, 11B provided to extend upwardly from both the right and left side edges of the bottom plate 11A and crimped so as to wrap a conductor of the electric wire disposed on an inner surface of the bottom plate 11A. The coated crimping portion 12 is formed to have a substantially U-shaped cross section by a bottomplate 12A and a pair of conductor crimping pieces 12B, 12B provided to extend upwardly from both the right and left side edges of the bottom plate 12A and crimped so as to wrap the electric wire (portion with an insulating coating) disposed on an inner surface of the bottom plate 12A.

The first connection portion 13 and the second connection portion 14 provided respectively in front of and behind the conductor crimp portion 11 are formed to have a U-shaped cross section respectively by bottom plates 13A and 14A and low profile side plates 13B and 14B uprising from both the right and left side edges of the bottom plates 13A and 14A.

The bottom plates (the bottom plate 13A of the first connection portion 13, the bottom plate 11A of the conductor crimp portion 11, the bottom plate 14A of the second connection portion 14, and the bottomplate 12A of the coated crimping portion 12) ranging from the bottom plate (not illustrated) of the electric correction portion 10 on the front side to the coated crimping portion 12 on the tail end side are continuously formed into a band plate shape. The front and rear ends of a low profile side plate 13B of the first connection portion 13 are continued respectively to a lower half portion of a rear end of a side plate (reference numeral is omitted) of the electrical connection portion 10 and a lower half portion of a front end of the conductor crimping piece 11B of the conductor crimp portion 11, and the front and rear ends of a low profile side plate 14B of the second connection portion 14 are continued respectively to a lower half portion of a rear end of the conductor crimping piece 11B of the conductor crimp portion 11 and a lower half portion of a front end of a coated crimping piece 12B of the coated crimping portion 12.

Before the conductor crimp portion 11 is crimped to the conductor Wa of the electric wire W, among an inner surface 11R and an outer surface 11S of the conductor crimp portion 11, the inner surface 11R on the side in contact with the conductor Wa of the electric wire W is provided with a larger number of small circular recesses 20 as concave serrations so that a large number of small circular recesses as serrations are scattered in a zigzag pattern in a state of being spaced apart from each other.

However, in the above case, a strip-shaped serration non-forming region 22 where the small circular recesses 20 as serrations are not formed is secured in an intermediate portion in a front-back direction of the conductor crimp portion 11.

When the conductor crimp portion 11 of the crimp terminal 1 is crimped to the conductor Wa of the end of the electric wire W, the crimp terminal 1 is placed on a placing surface (upper surface) of a lower die (anvil) (not illustrated), and, at the same time, the conductor Wa of the end of the electric wire W is inserted between the conductor crimping pieces 11A of the conductor crimp portion 11 and placed on an upper surface (the inner surface 11R) of the bottom plate 11A. Then, an upper die (crimper) is relatively lowered relative to the lower die, whereby a front end side of the conductor crimping piece 11B is gradually pulled inward by a guide slope of the upper die.

The upper die (crimper) is then further relatively lowered relative to the lower die, whereby eventually the front end of the conductor crimping piece 11B is rounded so as to be folded back to the conductor side by a curved surface continued from the guide slope of the upper side to a central mountain-shaped portion, and the front ends of the conductor crimping pieces 11B are dug in the conductor Wa while rubbing each other, whereby the conductor crimping pieces 11B are crimped so as to wrap the conductor Wa.

According to the above operation, the conductor crimp portion 11 of the crimp terminal 1 can be connected to the conductor Wa of the electric wire W by crimping. Similarly, in the coated crimping portion 12, the coated crimping piece 12B are gradually folded inward by using lower and upper dies and crimped to a portion with an insulating coating Wb of the electric wire W. Consequently, the crimp terminal 1 can be electrically and mechanically connected to the electric wire W.

Figure 8:
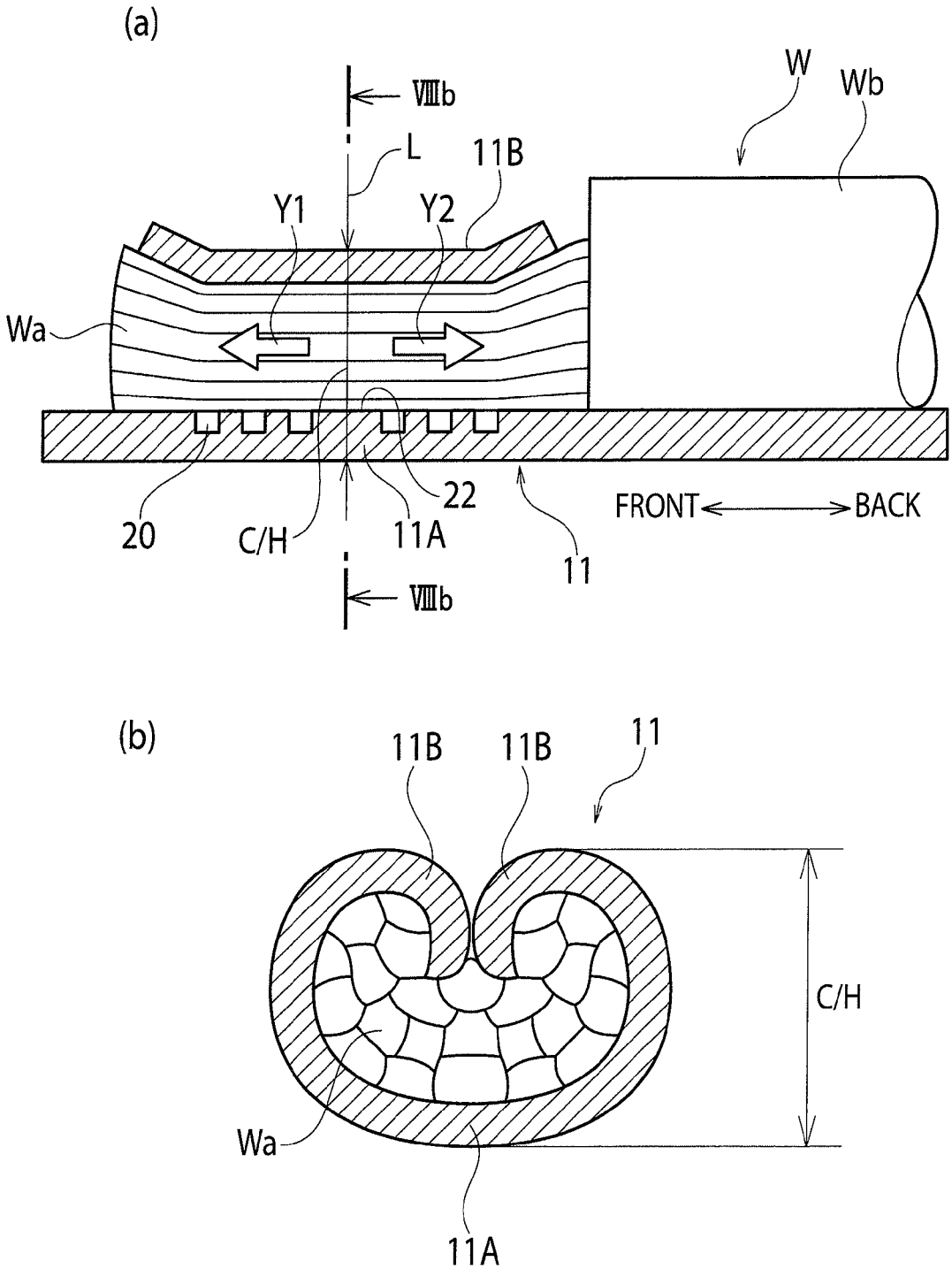
FIG. 8 is a constitution diagram of a portion in which the conductor crimp portion of the crimp terminal of FIG. 6 is crimped to a conductor of an electric wire, FIG. 8(*a*) is a longitudinal cross-sectional view, and FIG. 8(*b*) is a VIIIb-VIIIb arrowed cross-sectional view of FIG. 8(*a*).

FIG. 8 is a constitution diagram of a portion in which the conductor crimp portion 11 is crimped to the conductor Wa exposed by stripping the insulating coating Wb of the end of the electric wire W, FIG. 8(*a*) is a longitudinal cross-sectional view, and FIG. 8B is a VIIIb-VIIIb arrowed cross-sectional view of FIG. 8(*a*).

When the conductor crimp portion 11 is crimped to the conductor Wa of the electric wire W, the conductor Wa extends in the front-back direction in the conductor crimp portion 11. When the conductor Wa extends, the flowing conductor Wa rubs with hole edges of serrations (the small circular recesses 20), whereby an oxide film on the surface of the conductor Wa is peeled, and a newly formed surface of the conductor Wa is in contact with and electrically connected to the terminal 1. In such case, in the conductor Wa, a portion of the conductor Wa located in front of an intermediate point L in the front-back direction extends forward (arrow Y1 direction), and a portion behind the intermediate point in the front-back direction extends backward (arrow Y2). Namely, in the conductor crimp portion 11, the intermediate portion in the front-back direction of the conductor Wa moves little in the front-back direction. Since the non-forming region 22 formed with no serration (the small circular recesses 20) exists in the unmoving portion, there is no useless serration (the recesses 20).

In the crimping, although a thinned portion of a bottom portion of the serration (the small circular recess 20) is concentrically extended, the number of the serrations is reduced by the provision of the non-forming region 22, a volume of a terminal material deformed with pressing at the time of crimping is reduced, and since an escaping amount of the terminal material is reduced, finishing accuracy of a crimped portion is enhanced.

Since the compressibility (crimp height C/H) can be measured at a portion of the non-forming region 22 at a central portion formed with no serration (the small circular recess 20) can be measured, variation of a sample for compressibility observation is reduced, and compressibility measurement accuracy is improved; therefore, compressibility management at the site is facilitated.

In the above embodiment, although the crimp terminal 1 is a male terminal fitting having the box-type electrical connection portion 10, the present invention is not limited thereto, and the crimp terminal 1 may be a male terminal fitting having a male tab, a so-called LA terminal in which a through hole is formed in a metal plate material, or, if necessary, may be a crimp terminal having any shape.

Hereinabove, although the embodiment of the present invention has been described, the present invention is not limited to the above embodiment and may be variously modified.

The invention claimed is:

1. A crimp terminal comprising:

an electrical connection portion provided in a front portion in a longitudinal direction of the crimp terminal; and a conductor crimp portion provided behind the electrical connection portion and crimped and connected to a conductor of an end of an electric wire, the conductor crimp portion having a cross section formed into a U-shape by a bottom plate and a pair of conductor crimp pieces provided to extend upwardly from both right and left side edges of the bottom plate and crimped to wrap the conductor disposed on an inner surface of the bottom plate, wherein the conductor crimp portion before being crimped to the conductor of the end of the electric wire comprises, in a flush inner surface of the conductor crimp portion, circular recesses as serrations recessed from the flush inner surface of the conductor crimp portion and scattered to be spaced from each other, and a strip-shaped serration non-forming region provided in an intermediate portion in a front-back direction of the conductor crimp portion and formed without the recesses.

2. The crimp terminal of claim 1 wherein the strip-shaped serration non-forming region has a width greater than a spacing between adjacent circular recesses.

3. A crimp terminal comprising:

an electrical connection portion provided in a front portion in a longitudinal direction of the crimp terminal; and a conductor crimp portion provided behind the electrical connection portion and crimped and connected to a conductor of an end of an electric wire, the conductor crimp portion having a cross section formed into a U-shape by a bottom plate and a pair of conductor crimp pieces provided to extend upwardly from both right and left side edges of the bottom plate and crimped to wrap the conductor disposed on an inner surface of the bottom plate, wherein the conductor crimp portion before being crimped to the conductor of the end of the electric wire comprises, in a flush inner surface of the conductor crimp portion, circular recesses as serrations, recessed from the flush inner surface of the conductor crimp portion, spaced from each other in a zigzag pattern, and a strip-shaped serration non-forming region provided in an intermediate portion in a front-back direction of the conductor crimp portion and formed without the recesses.

4. The crimp terminal of claim 3 wherein the strip-shaped serration non-forming region has a width greater than a spacing between adjacent circular recesses.

* * * * *